US005867195A

United States Patent [19]

Kaneko et al.

[11] Patent Number: 5,867,195

[45] Date of Patent: Feb. 2, 1999

[54] INK JET RECORDING APPARATUS AND RECORDING HEAD HAVING AN AIR CHAMBER DEFINING A CLOSED SPACE IN COMMUNICATION WITH A LIQUID CHAMBER

[75] Inventors: Mineo Kaneko; Masayuki Kyoshima, both of Hiratsuka, Japan

[73] Assignee: Canon Kabushiki Kaisha, Tokyo, Japan

[21] Appl. No.: 290,072

[22] Filed: Aug. 15, 1994

Related U.S. Application Data

[63] Continuation of Ser. No. 200,559, Feb. 22, 1994, abandoned, which is a continuation of Ser. No. 814,088, Dec. 24, 1991, abandoned, which is a continuation of Ser. No. 471,068, Jan. 29, 1990, abandoned, which is a continuation of Ser. No. 169,580, Mar. 17, 1988, abandoned.

[30] Foreign Application Priority Data

Mar. 20, 1987 [JP] Japan ..... 62-64043
Mar. 28, 1987 [JP] Japan ..... 62-72985

[51] Int. Cl.[6] ..... B41J 2/19
[52] U.S. Cl. ..... 347/92; 347/30
[58] Field of Search ..... 347/94, 92, 85, 347/30

[56] References Cited

U.S. PATENT DOCUMENTS

| | | | |
|---|---|---|---|
| 3,083,689 | 4/1963 | Hegener | 346/140.1 |
| 3,805,276 | 4/1974 | Ishii | 347/85 |
| 3,930,260 | 12/1975 | Sicking | 347/94 X |
| 4,015,272 | 3/1977 | Yamamori | 347/92 |
| 4,126,868 | 11/1978 | Kirner | 347/86 |
| 4,149,172 | 4/1979 | Heinzl et al. | 347/92 |
| 4,158,847 | 6/1979 | Heinzl et al. | 347/94 X |
| 4,383,263 | 5/1983 | Ozawa | 347/30 |
| 4,394,669 | 7/1983 | Ozawa | 347/86 |
| 4,536,777 | 8/1985 | Matsumoto | 347/85 |
| 4,571,599 | 2/1986 | Rezanka | 347/87 |
| 4,628,333 | 12/1986 | Terasawa | 347/30 X |

FOREIGN PATENT DOCUMENTS

| | | | |
|---|---|---|---|
| 0252677 | 1/1987 | European Pat. Off. | B41J 3/04 |
| 2323220 | 11/1974 | Germany | B41J 3/04 |
| 2460573 | 1/1976 | Germany | B41J 27/00 |
| 2536369 | 3/1976 | Germany | B41J 27/00 |
| 2543452 | 3/1977 | Germany | B41J 27/00 |
| 3209947 | 12/1983 | Germany | B41J 27/00 |
| 32975 | 2/1982 | Japan | B41J 3/04 |
| 359098859 | 6/1984 | Japan | B41J 3/04 |
| 361169254 | 7/1986 | Japan | B41J 3/04 |
| 1492298 | 11/1977 | United Kingdom | B41J 3/04 |
| 1514085 | 6/1978 | United Kingdom | B41J 3/04 |
| 2112715 | 7/1983 | United Kingdom | B41J 3/04 |
| 2193163 | 2/1987 | United Kingdom | B41J 3/04 |

*Primary Examiner*—Joseph Hartary
*Attorney, Agent, or Firm*—Fitzpatrick, Cella, Harper & Scinto

[57] ABSTRACT

An ink jet recording apparatus includes a recording head having a discharge port for discharging ink, a liquid chamber communicating with the discharge port, a supply port provided in the liquid chamber for supplying ink to the liquid chamber, a communication port provided in the liquid chamber, and an air chamber communicating with the liquid chamber through the communication port to define a closed space in communication only with the liquid chamber. The cross-sectional area of the communication port is smaller than both the cross-sectional area of the air chamber and the area of the wall of the liquid chamber on which the communication port is located.

19 Claims, 5 Drawing Sheets

PRIOR TO FILLING INK

DURING FILLING INK

AFTER FILLING INK

INK JET RECORDING APPARATUS AND RECORDING HEAD HAVING AN AIR CHAMBER DEFINING A CLOSED SPACE IN COMMUNICATION WITH A LIQUID CHAMBER

This application is a continuation of application Ser. No. 08/200,559 filed Feb. 22, 1994 abandoned, which is a continuation of application Ser. No. 07/814,088 filed Dec. 24, 1991 abandoned, which is a continuation of application Ser. No. 07/471,068 filed Jan. 29, 1990 abandoned, which is a continuation of application Ser. No. 07/169,580 filed Mar. 17, 1988 abandoned.

BACKGROUND OF THE INVENTION

1. Field of the Invention

This invention relates to a recording head and an ink jet recording apparatus having the recording head wherein ink is discharged to form droplets of the ink and the droplets are caused to adhere to a recording medium such as paper to thereby accomplish recording.

2. Related Background Art

The ink jet recording method is a recording method whereby ink (recording liquid) is discharged from an opening provided in a recording head and is caused to adhere to a recording medium such as paper to thereby accomplish recording, and has the numerous advantages that very little noise is produced, that high-speed recording is possible, that plain paper can be used and that recording paper of special construction is not required. Ink jet recording heads and ink jet recording apparatus of various types have heretofore been devised. As shown in FIG. 1 of the accompanying drawings, an ink jet recording apparatus according to the prior art is provided with a restoring system as shown in FIG. 2 for the purposes of filling a liquid chamber with ink during the interchange of a head and preventing unsatisfactory discharge or non-discharge, or recovering the apparatus from unsatisfactory discharge. That is, when the head 52 is to be filled up with ink during the interchange of the head, a cap 51 may be brought into intimate contact with a front face plate 56 in FIG. 1, negative pressure may be generated in the cap 51 by negative pressure generating means or a suction pump 57, and ink may be poured into the head through a supply tube 58 communicated with an unshown ink tank, a liquid chamber 53 and liquid paths 54 in the named order and discharged from an orifice 55.

Now, the means of multiplying the discharge port 55 is adopted to improve the recording speed of the ink jet recording apparatus, but, for example, if an attempt is made to fill such a head with ink by the above-described method, the ink will flow out from the discharge port communicated with the liquid path in the lower portion before the ink completely fills up the interior of the liquid chamber. Because the liquid path row and the liquid chamber are long, a bubble 59 will sometimes remain in the liquid chamber 53 as shown in FIGS. 2 and 3 of the accompanying drawings. Such a bubble 59 cannot completely be removed even if the performance of the pump when supplying the ink to liquid chamber 3 by the pump is improved. In some cases, the adherence of the bubble 59 to the rear end of the liquid paths 54 (which is adjacent to the liquid chamber 53) has caused non-discharge and mal-discharge of the ink.

U.S. Pat. No. 4,158,847 discloses a printer head having air bubbles in an ink distributor device. However, this configuration also fails to resolve the above-stated drawbacks. Besides, in some occasions, owing to the vibration of the device, air bubbles in the ink distributor device would enter the ink passage. Thus the ink discharge is deteriorated.

SUMMARY OF THE INVENTION

The present invention has been made in view of the above-noted problems and an object thereof is to provide an ink jet recording head and an ink jet recording apparatus having a head in which the interior of a liquid chamber is completely filled up with ink even in the case of head structure in which liquid paths are arranged, for example, in a vertical direction (the direction of gravity).

Another object of the invention is to provide an ink jet recording head and an ink jet recording apparatus including a recording head having an efficient discharge of ink even just after the apparatus is shocked or vibrated.

Still another object of the invention is to provide a recording head for an ink jet recording apparatus comprising:

- a discharge port for discharging ink;
- a liquid chamber communicating with said discharge port;
- a supply port provided in said liquid chamber for supplying the ink to said liquid chamber;
- a communication port provided in said liquid chamber; and
- an air chamber communicating with said liquid chamber through said communication port.

Still another object of the invention is to provide an ink jet recording apparatus comprising:

- a recording head having a discharge port for discharging ink, a liquid chamber communicating with said discharge port,
- a supply port provided in said liquid chamber for supplying the ink to said liquid chamber, a communication port provided in said liquid chamber and an air chamber communicating with said liquid chamber through said communication port; and
- a cap for closing said discharge port.

DESCRIPTION OF THE PREFERRED EMBODIMENT

One of the features of the ink jet recording head according to the present invention is that an air chamber communicating with a liquid chamber by a member discrete from the liquid chamber is provided outside the liquid chamber. The function of the air chamber is to draw the air (and ink) in the liquid chamber into the inner portion thereof by negative pressure.

The volume of the air chamber according to the invention is determined in consideration of dimensions, shape and construction of the head, the relation between the head and the ink tank and the relation between the head and ink supply system, ink recovery system and others.

However, the following matters are to be carefully considered.

Figure 1:
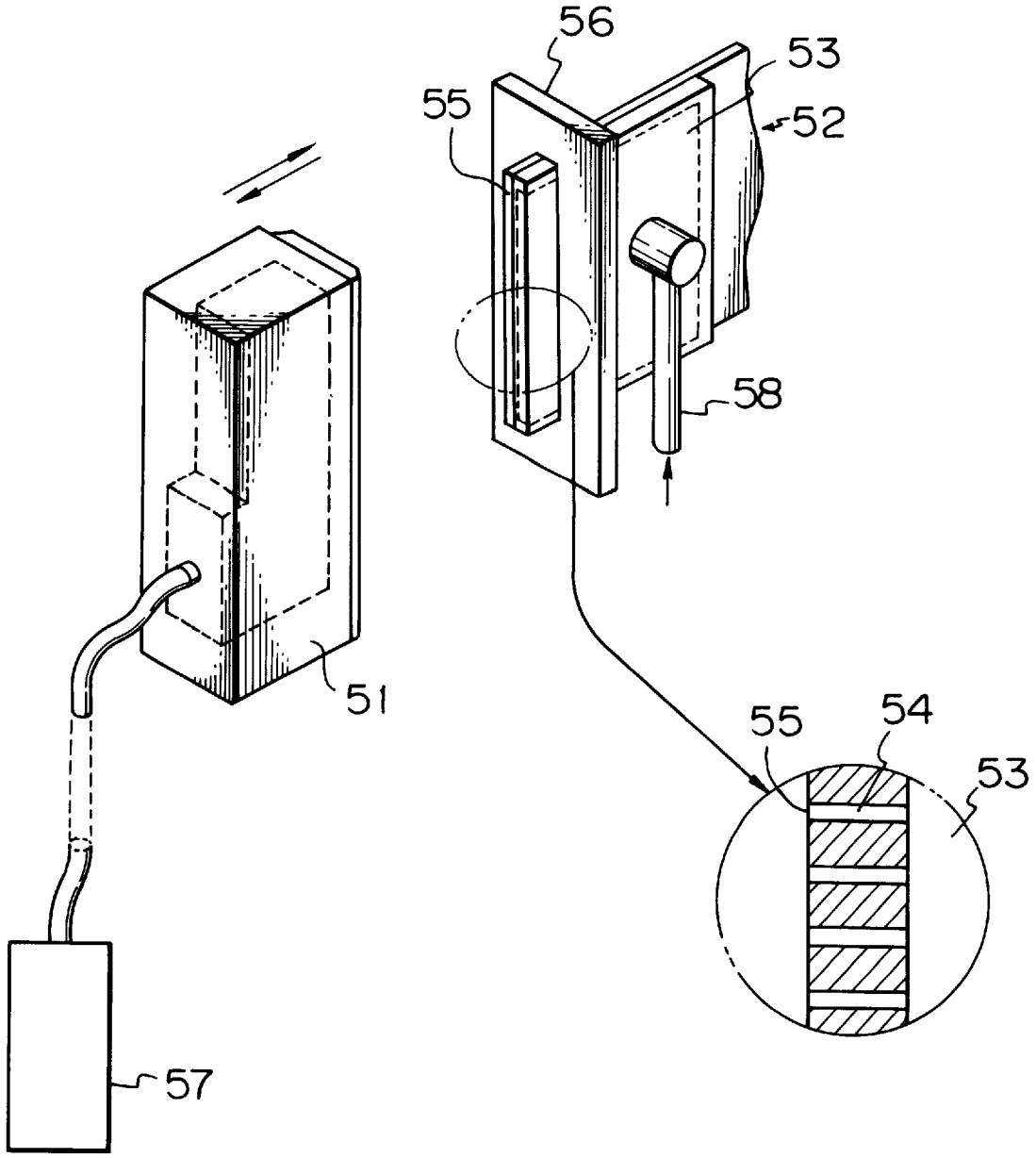
Fig. 1 PRIOR ART
FIG. 1 is a schematic perspective view of the prior art ink jet recording head and recovery system thereof (partially enlarged)
Figure 2:
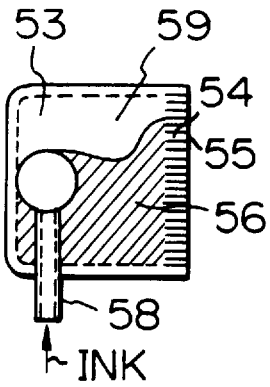
Fig. 2 PRIOR ART
FIGS. 2 and 3 are schematic views for explaining the drawbacks prior art ink jet recording head.
Figure 3:
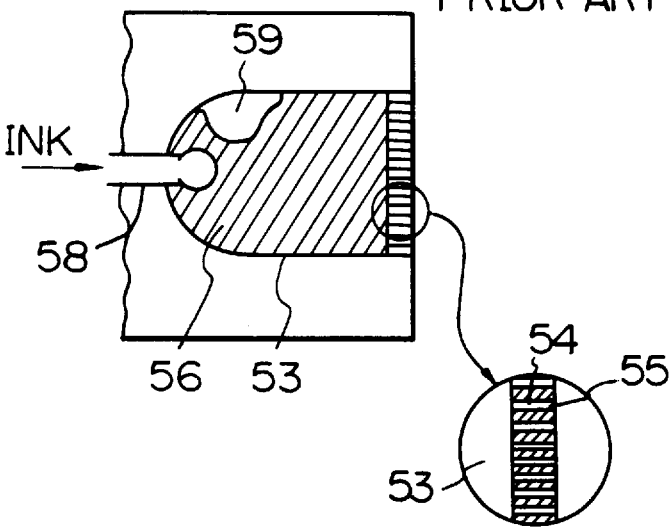
Fig. 3 PRIOR ART

If the volume of the air chamber is made too great, it will be difficult to generate the negative pressure necessary to draw such ink from an ink tank. Also, if the volume of the air chamber is too small, it will in some cases be impossible to introduce the bubble in the liquid chamber. Accordingly, the volume of the air chamber should preferably be great within a range permitted by the capability of a suction pump. Usually, the volume of the air chamber will suffice if it is ½ to 2 times as great as the volume of the liquid chamber. Also, the location at which the air chamber communicates with the liquid chamber may preferably be set at a location in which the bubble in the liquid chamber is liable to remain. That location is the upper portion of the liquid chamber in a case when, as shown in FIG. 1, the liquid paths are arranged vertically. (gravity direction), and is preferably the end portion of the liquid chamber which is remote from the ink supply port to the liquid chamber and in which the bubble is liable to remain, in a case when the liquid paths are arranged horizontally (perpendicular to the gravity direction).

According to the invention, if air is always present in the air chamber or the inlet of the air chamber (the communicating port between the air chamber and the liquid chamber) is made sufficiently narrow, the air will never flow back into the liquid chamber owing to the vibration of the apparatus and will not adversely affect the discharge. For this purpose, the diameter of the inlet of the air chamber may preferably be of the order of 1 to 2 mm.

Figure 4A:
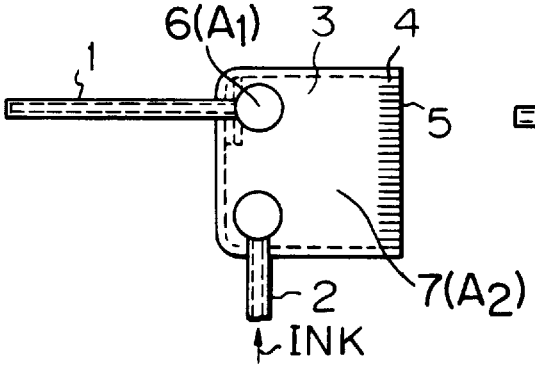
FIGS. 4A–4C are schematic views for explaining the process of filling the ink in the ink jet recording head according to an embodiment of the invention.
Figure 4B:
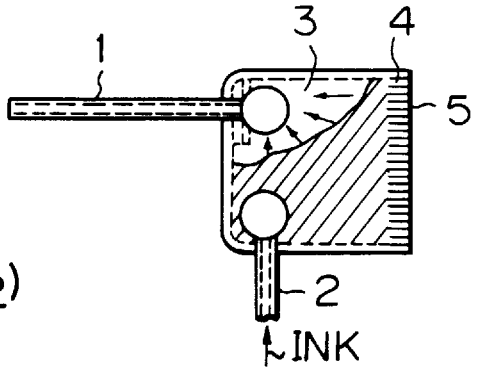

The area $A_1$ of the communicating port 6 between the air chamber and the liquid chamber is, due to the above-stated reason, preferably 1/100 to ¼, more preferably 1/50 to ⅕, most preferably 3/100 to 1/10 times so large as the area $A_2$ of the wall 7 of the liquid chamber on which the communicating port is provided (see FIG. 4A).

The following is used for the material forming the air chamber according to the invention, for example, glass, metal and other rigid material (first embodiment), and plastics such as polyethylene resin, polyvinyl resin, polystyrene resin, polystylene resin, polyester resin and polyamide resin, flexible material (second embodiment) with, for example, thickness of about 0.1 mm such as rubber.

(First Embodiment)

FIGS. 4A–4E show a first embodiment of the recording head of the present invention.

Figure 4C:
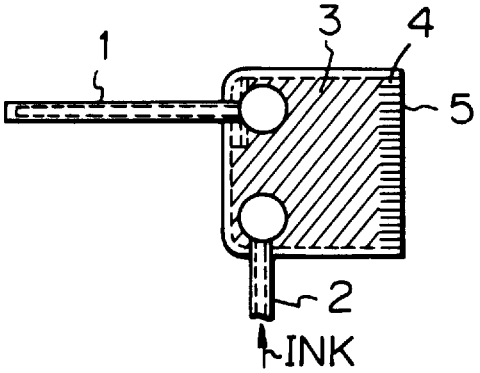
Figure 4D:
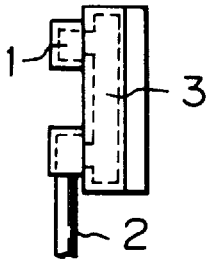
FIGS. 4D and 4E are schematic right side view and bottom view of the recording head shown in FIGS. 4A–4C, respectively.
Figure 4E:
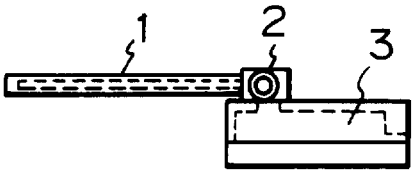

In FIGS. 4A–4E, unshown energy generating means (for example, an electro-mechanical converter such as a piezo element and an electro-thermal converter such as a heater) is provided in the liquid path 4 communicating with a discharge port 5 for discharging ink in order to generate the energy in use for discharging the ink. The liquid path 4 is communicating with the liquid chamber 3. In FIGS. 4A–4E, pipes are provided in the upper and lower portions of a liquid chamber 3, and the pipe in the upper portion is shut off at a suitable length (3–5 mm) to provide an air chamber 1; the lower portion of which is used for supply tube of 2 ink. In FIGS. 4A–4E, the air chamber 1 extends from the communication port 6 in the liquid chamber wall 7, but it should be understood that other shapes of air chamber may also be used. Considering a case when the head of such structure is filled with ink by a mechanism as shown in FIG. 1, the interior of the liquid chamber 3 and the interior of the air chamber 1 are first rendered into negative pressure by the negative pressure generated by a pump (FIG. 4A). Then the ink flows into the liquid chamber 3 and out of a discharge port 5 via a liquid path 4, but since at this time, the interior of the air chamber 1 is at negative pressure (FIG. 4B), the ink flows in the direction of the inlet of the air chamber 1 to eliminate the negative pressure and the liquid chamber 3 is filled up with the ink (FIG. 4C). Even if at this time, a small amount of bubble remains near the inlet of the air chamber 1, such bubble will be drawn into the air chamber 1 by the negative pressure in the air chamber 1. When a cap is finally opened to the atmosphere, and no bubble will remain in the liquid chamber 3.

Figure 5:
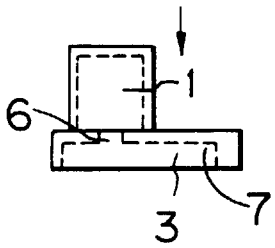
FIGS. 5–7 are schematic views showing embodiments of an air chamber according to the invention.
Figure 6:
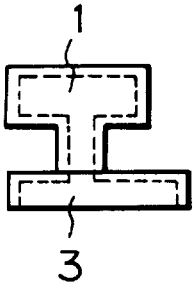
Figure 7:
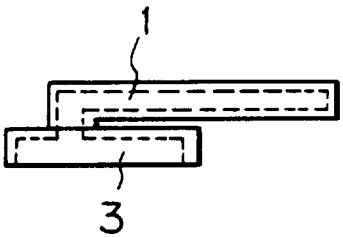

FIGS. 5–7 are other examples of the air chamber 1 according to the invention. In any of the examples, the area of the communication port between the air chamber 1 and the liquid chamber 3 is smaller than the area of the portion of wall of the liquid chamber 3, on which the communicating port is provided.

(Second Embodiment)

In the second embodiment according to the invention, at least a part of the air chamber 1 is formed by flexible material or elastic material outside of the liquid chamber 3 and the air chamber 1 is communicated with the liquid chamber 3.

According to the head like this, after the air chamber 1 is compressed, the ink is sucked into the liquid chamber 3 and the liquid path 4. After or during this process, the air chamber 1 is released from compression, such that the air chamber 1 will return to the original shape thereof by the elastic force and the negative pressure is generated in the air chamber 1.

Bubbles and a part of ink remaining in the liquid chamber 3 are sucked into the air chamber 1 by this negative pressure, thus the liquid chamber 3 is filled with the ink. Ink completely fills up the liquid chamber 3 and further passes to a part of the air chamber 1. Thereafter, the sucking operation is stopped.

Figure 9:
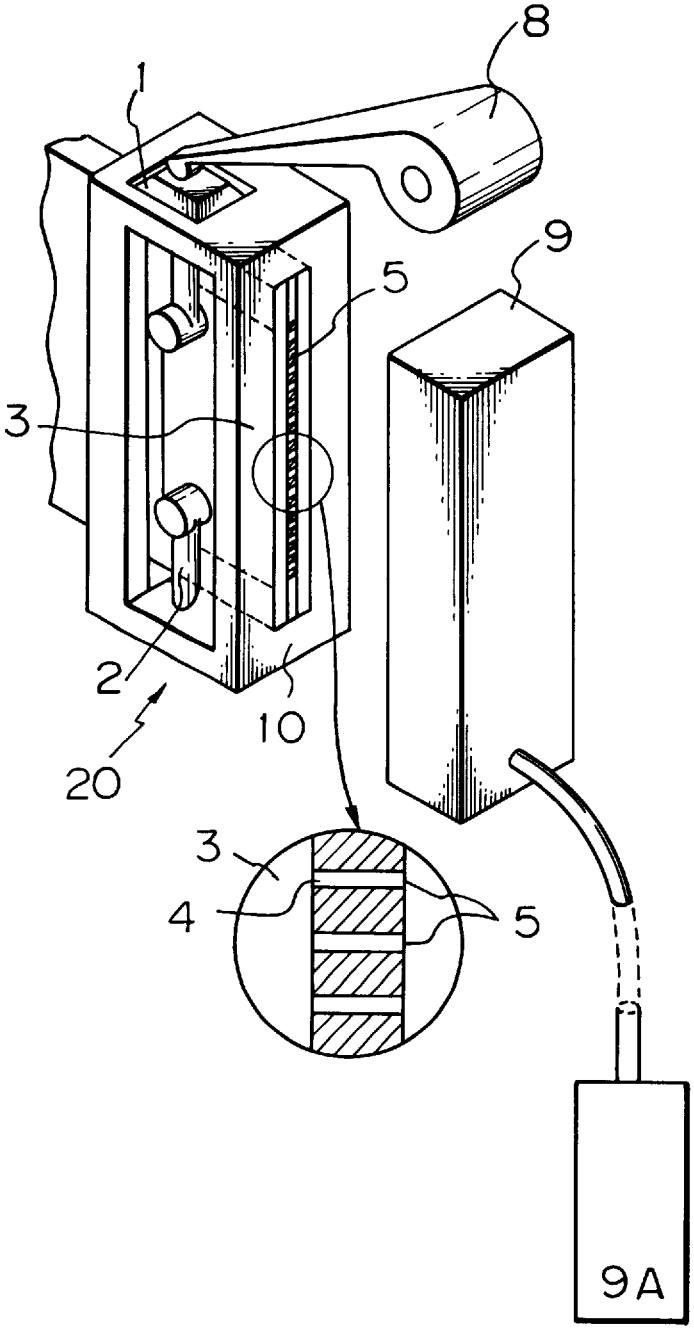
FIG. 9 is a schematic perspective view (partially enlarged) of the ink jet recording head shown in FIG. 8 and the recovery system.

FIG. 9 also shows a state where the recording head 20 is moved to the so-called home position opposed to the cap 9 of suction restoring means. In this apparatus, an air chamber 1 is first compressed by a compressor 8 of air chamber 1. The ink cap 9 connected to suction generating means 9A such as a pump is then brought into intimate contact with a support member 10, thus negative pressure generating means is operated and ink is sucked from an orifice. When the compressor 8 is returned to its orginal position while the ink is being sucked, the air chamber 1 restores its original shape by its force of restitution. At this time, the interiors of liquid chamber 3 and air chamber 1 assume a negative pressure state, and the ink fills the chamber.

Figure 8:
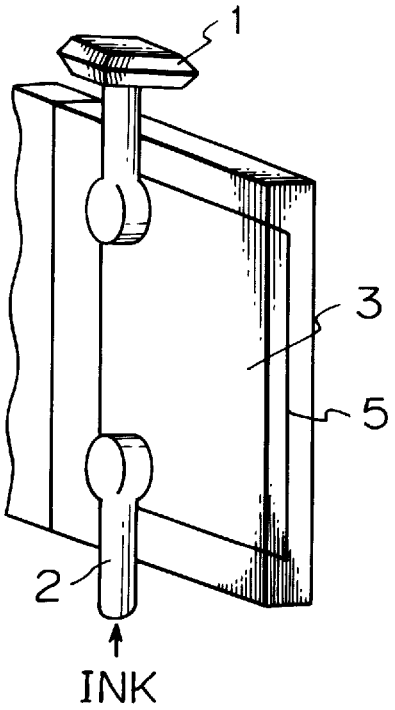
FIG. 8 is a schematic perspective view of the ink jet recording head according to another embodiment of the invention.

FIG. 9 shows a main part of the ink jet recording apparatus having the ink jet recording head shown in FIG. 8.

According to the ink jet recording head of this embodiment, discharge direction of the ink from the discharge port is substantially parallel to the direction in which the ink is supplied from the liquid chamber to the liquid path. The alteration may be utilized, for example, when the stated two directions are substantially perpendicular each other.

Figure 10:
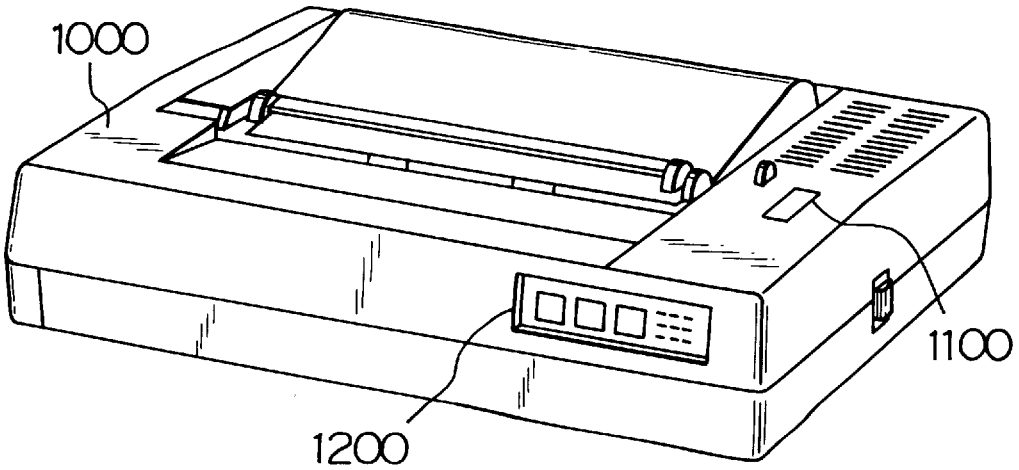
FIG. 10 is a schematic perspective view of the ink jet recording apparatus having the ink jet recording head according to the invention.

FIG. 10 is a schematic perspective view of an ink jet recording apparatus having the ink jet recording head according to the invention. Numerals 1000, 1100 and 1200 designate an apparatus body, an electrical source switch and an operation panel, respectively.

As stated above in detail, the present invention provides an ink jet recording head and an ink jet recording apparatus having the same in which, when the ink discharge is started after the head is exchanged, the ink discharge is not deteriorated and higher reliability is obtained.

Also, according to the invention, air in the air chamber prevents the vibration of the ink in the liquid chamber and the pressure wave (so-called back wave) to the upstream (in the direction to the liquid chamber) of the liquid path. Therefore, an ink jet recording head and an ink jet recording apparatus having the same in which cross-talk is not generated and the ink is discharged in a good manner is presented by the instant invention.

Further, the present invention provides an ink jet recording head and an ink jet recording apparatus in which the air in the air chamber does not flow back to the liquid chamber. Therefore, the ink is efficiently discharged after the apparatus is vibrated.

We claim:

1. An ink jet recording apparatus comprising:

an ink jet recording head having:

a plurality of discharge ports for discharging ink, a plurality of ink paths in communication with said discharge ports, each provided with an energy generating element to generate energy for discharging ink from each of said discharge ports, said ink paths being arranged in a predetermined array, an ink chamber communicating with said array of ink paths and having an upper portion corresponding to a position where air collects, a supply port at said ink chamber for supplying the ink to said ink chamber, a communication port provided on a side of said ink chamber at said upper portion thereof, opposed to said array of ink paths and disposed independently of said supply port, and an air chamber communicating with said ink chamber through said communication port to define a permanently closed space in communication only with said ink chamber, wherein said communication port between said air chamber and said ink chamber is narrowed;

said ink jet recording apparatus further comprising:

a pump member for generating a negative pressure; and a cap, connected to said pump member, for covering said discharge ports and applying the negative pressure to said ink chamber and said air chamber through said discharge ports, wherein said pump member generates the negative pressure in said air chamber so that after negative pressure from said pump member is relieved, said collected air is drawn into said air chamber by the negative pressure in said air chamber.

2. An ink jet recording apparatus according to claim 1, wherein said energy generating element comprises an electro-mechanical converter.

3. An ink jet recording apparatus according to claim 1, wherein said energy generating element comprises an electro-thermal converter.

4. An ink jet recording apparatus according to claim 1, wherein the direction of ink discharge from said discharge ports is substantially parallel to the direction of ink supply from said ink chamber to said plurality of ink paths.

5. An ink jet recording apparatus according to claim 1, wherein the direction of ink discharge from said discharge ports is substantially perpendicular to the direction of ink supply from said ink chamber to said plurality of ink paths.

6. An ink jet recording apparatus according to claim 1, wherein the inner volume of said air chamber is ½ to 2 times as large as the inner volume of said ink chamber.

7. An ink jet recording apparatus according to claim 6, wherein said communication port is provided on the upper portion of said ink chamber, whereby said air chamber and said communication port enable negative pressure to be generated in said air chamber to draw ink into said ink chamber through said supply port.

8. An ink jet recording apparatus according to claim 1, wherein the diameter of said communication port is 1 to 2 mm.

9. An ink jet recording apparatus according to claim 1, wherein the area of said communication port is 1/50 to 1/5 times as large as the area of said wall in said ink chamber which contains said communication port.

10. An ink jet recording apparatus according to claim 1, wherein the area of said communication port is 3/100 to 1/10 times as large as the area of said wall in said ink chamber which contains said communication port.

11. An ink jet recording apparatus according to claim 1, wherein said air chamber is formed by rigid material.

12. An ink jet recording apparatus according to claim 11, wherein said rigid material comprises glass.

13. An ink jet recording apparatus according to claim 11, wherein said rigid material comprises metal.

14. An ink jet recording apparatus according to claim 1, wherein said air chamber is formed by flexible material.

15. An ink jet recording apparatus acccording to claim 14, said flexible material comprises plastics.

16. An ink jet recording apparatus according to claim 15, wherein said plastics comprises polyethylene.

17. An ink jet recording apparatus according to claim 14, wherein said flexible material comprises rubber.

18. A method of supplying ink to an ink jet recording head having:

a plurality of discharge ports for discharging ink, a plurality of ink paths in communication with said discharge ports, each provided with an energy generating element to generate energy for discharging ink from each of said discharge ports, being arranged in said ink paths, an ink chamber communicating with said ink paths and having an upper portion corresponding to a position where air collects, a supply port at said ink chamber for supplying the ink to said ink chamber, a communication port provided on a side of said ink chamber at said upper portion thereof, said communication port being disposed independently of said supply port, and an air chamber communicating with said ink chamber through said communication port to define a permanently closed space in communication only with said ink chamber, wherein said communication port between said air chamber and said ink chamber is narrowed, the method comprising the steps of:

covering said plurality of discharge ports with a cap;

generating a negative pressure in said ink chamber and in said closed space of said air chamber by driving a pump through said cap, said discharge ports and said ink paths;

supplying the ink through said supply port into said ink chamber;

relieving negative pressure from said pump; and after negative pressure from said pump is relieved, drawing said collected air into said air chamber by said negative pressure in said closed space of said air chamber.

19. A method according to claim 18, wherein the inner volume of said air chamber is ½ to 2 times as large as the inner volume of said ink chamber and said communication port is provided on the upper portion of said ink chamber, whereby said air chamber and said communication port enable negative pressure to be generated in said air chamber to draw ink into said ink chamber through said supply port.

* * * * *

UNITED STATES PATENT AND TRADEMARK OFFICE

CERTIFICATE OF CORRECTION

PATENT NO. : 5,867,195

DATED : February 2, 1999

INVENTORS : Mineo Kaneko, et al.

It is certified that error appears in the above-identified patent and that said Letters Patent is hereby corrected as shown below:

COVER PAGE

Under [56] References Cited, Foreign Patent Documents,
"359098859" should read --59-98859--;
"361169254" should read --61-169254--; and
"32965" should read --57-32975--.

COLUMN 3

Line 27, "vertically." should read --vertically--;
Line 49, "polyvinyl resin," should read --polyvinyl resin, polypropylene resin,--; and
Line 50, "polystylene resin," should be deleted.

COLUMN 4

Line 19, "and" should be deleted.

COLUMN 6

Line 45, "said" should read --wherein said--; and

UNITED STATES PATENT AND TRADEMARK OFFICE

CERTIFICATE OF CORRECTION

PATENT NO. : 5,867,195

DATED : Feb. 2, 1999

INVENTOR(S) : Mineo Kaneko, et al.

It is certified that error appears in the above-indentified patent and that said Letters Patent is hereby corrected as shown below:

Line 47, "comprises" should read --comprise--.

Signed and Sealed this

Fifth Day of October, 1999

*Attest:*

*Attesting Officer*

Q. TODD DICKINSON

*Acting Commissioner of Patents and Trademarks*